United States Patent [19]

Hoshall

[11] 4,273,296

[45] Jun. 16, 1981

[54] MATERIAL MOVING APPARATUS

[76] Inventor: Tom C. Hoshall, 4005 N. Penn., Oklahoma City, Okla. 73112

[21] Appl. No.: 29,642

[22] Filed: Apr. 13, 1979

[51] Int. Cl.[3] ..... B02C 13/10

[52] U.S. Cl. ..... 241/60; 241/188 R; 241/248

[58] Field of Search ..... 406/135; 241/57, 60, 241/101 A, 188 R, 191, 186.2, 186 R, 277, 260.1, 248

[56] References Cited

U.S. PATENT DOCUMENTS

| | | | |
|---|---|---|---|
| 3,061,206 | 10/1962 | Matter | 241/101 A X |
| 3,529,870 | 9/1970 | Woten | 406/135 X |
| 3,556,418 | 1/1971 | Hokana | 241/60 |
| 3,995,775 | 12/1976 | Birkmeier et al. | 406/135 X |
| 4,084,753 | 4/1978 | Fruh | 241/34 |

*Primary Examiner*—Mark Rosenbaum

*Attorney, Agent, or Firm*—Dunlap, Codding & McCarthy

[57] ABSTRACT

The present invention contemplates an improved material moving apparatus which is particularly useful for blowing insulation material into portions of various structures. The apparatus includes: a hopper, having a chamber; a hopper blade assembly; a blower assembly; and a discharge conduit. The material is discharged into the hopper chamber, contacted by the hopper blade assembly, and moved through the blower assembly into the discharge conduit for discharging the material from the material moving apparatus.

12 Claims, 2 Drawing Figures

MATERIAL MOVING APPARATUS

BACKGROUND OF THE INVENTION

Field of the Invention

The present invention relates generally to an improved material moving apparatus and, more particularly, but not by way of limitation, to an improved apparatus for blowing insulation.

DESCRIPTION OF THE PREFERRED EMBODIMENT

Figure 1:
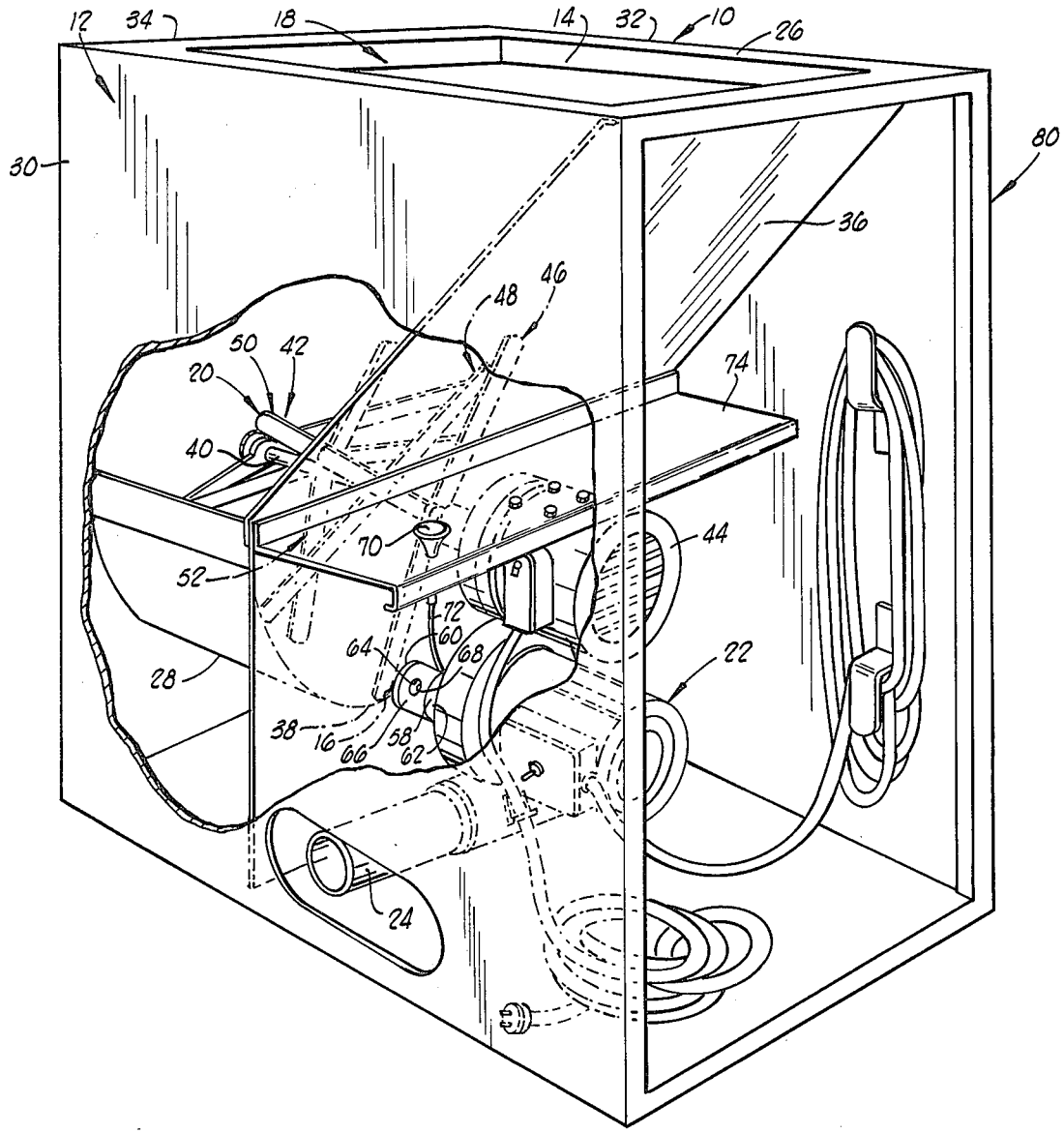
FIG. 1 is a partial perspective, partial diagrammatic view of the material moving apparatus of the present invention.

Referring to the drawings in general and to FIG. 1 in particular, shown therein and designated via the general reference numeral 10 is a material moving apparatus constructed in accordance with the present invention. In general, the material moving apparatus 10 includes: a hopper 12, having a material receiving opening 14, a material discharge opening 16 and a chamber 18, the material receiving and discharge openings 14 and 16, respectively, each being in communication with the chamber 18; a hopper blade assembly 20 which is disposed in the hopper chamber 18; a blower assembly 22; and a discharge conduit 24 which is connected to the blower discharge.

In general, the material, such as insulation material, for example, is discharged into the chamber 18 through the material receiving opening 14. The material falls or moves through the chamber 18 generally toward the material discharge opening 16. As the material falls toward the material discharge opening 16, the material is contacted by the hopper blade assembly 20, the hopper blade assembly 20 cooperating to shred the material and move the material from the hopper chamber 18 toward and through the material discharge opening 16 for discharging the material from the chamber 18. The material discharged through the hopper material discharge opening 16 is received at the blower inlet of the blower assembly 22 and forcibly discharged by the blower assembly 22 into and through the discharge conduit 24, the material being discharged from the material moving apparatus 10 via the discharge conduit 24. In a particular insulation blowing application, one end of a flexible conduit (not shown) is connected to the discharge conduit 24 for guiding the discharged material into portions of various structures.

The hopper 12 has an upper end 26 and a lower end 28, the material receiving opening 14 being formed through the upper end 26. More particularly, the hopper 12 includes a first sidewall 30, a second sidewall 32, a first end wall 34, second end wall 36, and a lower end wall 38. The walls 30, 32, 34, 36 and 38 are interconnected to encompass and form the hopper chamber 18.

A portion of the second end wall 36, extending a distance from the upper end 26 toward the lower end 28 of the hopper 18 is formed on an incline, the inclined portion of the wall 36 cooperating to move the material in the chamber 18 generally toward the lower end 26. The lower end wall 38 is formed on a radius and the material discharge opening 16 is formed through the second end wall 36, generally adjacent the lower end wall 38 and generally adjacent the lowermost portion of the chamber 18.

The hopper blade assembly 20 includes a shaft 40, a plurality of blades 42 and a blade drive 44. The shaft 40 is disposed in the hopper chamber 18 and extends generally between the first and the second end walls 34 and 36, respectively, the shaft 40 being journally connected to the end walls 34 and 36 so that the shaft 40 is rotatably mounted in the hopper 12. One end portion of the shaft 40 extends through the second end wall 36 and is connected to the blade drive 44, the blade drive 44 being secured to the second end wall 36.

In one form, the blade drive 44 is an electric motor and, in an activated condition of the blade drive 44, the blade drive 44 operates to rotatingly drive the shaft 40 thereby rotating the blades 42. The blades 42 are disposed within the hopper chamber 18 and positioned to contact the material as the material falls through the chamber 18 generally from the upper end 26 toward the lower end 28. Further, the blades 42 are oriented and positioned on the shaft 40 to cooperate in moving the material from the chamber 18 through the material discharge opening 16.

The hopper blade assembly 20, more particularly, includes: a first pair of blades 46, one end of each of the first pair of blades being connected to the shaft 40 and each of the blades of the first pair of blades 46 extending generally radially from the shaft 40 in opposite directions; a second pair of blades 48, one end of each blade of the second pair of blades 48 being connected to the shaft 40 and each blade of the second pair of blades extending generally radially from the shaft 40 in opposite directions; a third pair of blades 50, one end of each blade of the third pair of blades 50 being connected to the shaft 40 and each blade of the third pair of blades 50 extending generally radially from the shaft 40 in opposite directions; and a fourth pair of blades 52, one end of each blade of the fourth pair of blades 52 being connected to the shaft 40 and each blade of the fourth pair of blades 52 extending generally radially from the shaft 40 in opposite directions. As diagrammatically shown in FIG. 2, the first pair of blades is positioned on the shaft 40 such that the first pair of blades 46 is disposed generally near the second end wall 36 of the hopper 12. The second pair of blades is positioned on the shaft 40, spaced a distance from the first pair of blades 46 in a direction generally from the second end wall 36 toward the first end wall 34. The third pair of blades 50 is positioned on the shaft 40 and spaced a distance from the second pair of blades 48 in the direction generally from the second end wall 36 to the first end wall 34 of the chamber 18, the second pair of blades 48 being positioned generally between the first pair of blades 46 and the third pair of blades 50. The fourth pair of blades 52 is positioned on the shaft 40 such that the fourth pair of blades 52 is disposed generally near the first end wall 34, the third pair of blades 50 being disposed generally between the second pair of blades 48 and the fourth pair of blades 52.

Each of the blades 42 has a length sufficient such that the end of each of the blades 42, generally opposite the end which is connected to the shaft 40, is disposed near the lower end wall 38 during the rotation of the blades 42. The lower end wall 38 is formed on a curve or radius to encourage the movement of the material within the chamber 18 generally toward the lower end 28 of the hopper 12 and the radius of curvature of the lower end wall 38 generally corresponds to the radius formed by each of the blades 42 extending from the shaft 40 to minimize the distance between the lower end wall 38 and the outermost ends of the blades 42, opposite the ends of the blades 42 connected to the shaft 40.

The first, the second, the third and the fourth pair of blades 46, 48, 50 and 52, respectively, each extend angularly from the shaft 40 to cooperate in moving the material disposed in the hopper chamber 18 near the lower end 28 from the hopper chamber 18 and through the material discharge opening 16. More particularly, the second pair of blades is angularly disposed on the shaft 40 to cross a first reference line 54 which extends radially from the shaft 40 and is disposed generally between the second pair of blades 48 and the third pair of blades 50. The third pair of blades is angularly oriented on the shaft 40 such that the third pair of blades 50 crosses or passes through the first reference line 54. In addition, the third pair of blades 50 is angularly oriented and positioned on the shaft 40 such that the third pair of blades 50 crosses or passes through a second reference line 56 which extends radially from the shaft 40 and is disposed generally between the third pair of blades 50 and the fourth pair of blades 52. The fourth pair of blades 52 is angularly oriented and positioned on the shaft 40 such that the fourth pair of blades 52 crosses or passes through the second reference line 56. The angular orientation of the pairs of blades 46, 48, 50 and 52 enhances the ability of the blades 42 to cooperate in moving the material disposed near the lower end 28 of the hopper 12 in a direction generally from the first end wall 34 toward the second end wall 36 and through the material discharge opening 16 thereby discharging the material from the chamber 18.

Figure 2:
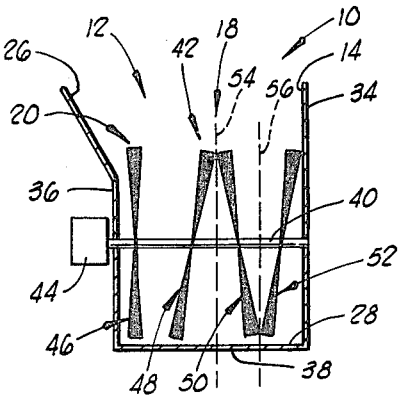
FIG. 2 is a diagrammatic view illustrating the orientation of the hopper blade assembly utilized in the material moving apparatus shown in FIG. 1.

As diagrammatically indicated in FIG. 2, the first, the second, the third and the fourth pairs of blades 46, 48, 50 and 52 each have a blade pitch to facilitate the moving of the material in a direction from the first end wall 34 toward the second end wall 36 and through the material discharge opening 16, the blade pitch being designed to cooperate with the angular orientation and position of the blades 42 on the shaft 40 such that the blades 42 cooperate to provide an auger type of action for moving the material in the direction generally from the first end wall 34 toward the second end wall 36 and through the material discharge opening 16. In one embodiment, the blades of the first pair of blades 46 each have a thirty-five degree (35°) blade pitch, the blades of the second pair of blades 48 each have a forty-five degree (45°) blade pitch, the blades of the third pair of blades 50 each have a forty-five degree (45°) blade pitch and the blades of the fourth pair of blades 52 each have a sixty degree (60°) blade pitch. Further, in one operational embodiment, the first pair of blades 46 are positioned on the shaft 40 such that the blades of the first pair of blades 46 each pass within about one-fourth of an inch from the second end wall 36 and the blades of the fourth pair of blades 52 are positioned on the shaft such that the blades of the fourth pair of blades 52 each pass within about one-fourth of an inch from the first end wall 34.

The material moving apparatus 10 also includes a delivery tube 58 having an opening extending therethrough and opposite ends 60 and 62. The end 60 of the delivery tube 58 is connected to the second end wall 36 of the hopper 12 generally near the lower end 28. The delivery tube 58 is positioned on the hopper 12 such that the delivery tube 58 encompasses the material discharge opening 16, the opening through the delivery tube 58 being in communication with the material discharge opening 16. The end 62 of the delivery tube 58 is connected to the blower assembly 22 and positioned on the blower assembly 22 such that the opening through the delivery tube 58 is in communication with the blower inlet.

An air opening 64 is formed through the delivery tube 58 in communication with the delivery tube opening for introducing air into the stream of material flowing through the delivery tube opening 58 to the blower inlet of the blower assembly 22. A collar 66 is disposed about the delivery tube 58 and a collar opening 68 is formed through the collar 66. The collar 66 is rotatable on the delivery tube 58 to a position wherein the collar opening 68 is aligned with the air opening 64, as shown in FIG. 1, and to positions wherein the collar 66 partially closes or entirely closes the air opening 64, the collar 66 being movable on the delivery tube 58 to regulate the amount or volume of air passing through the air opening 64 and into the delivery tube 58 opening by, in essence, varrying the size of the air opening 64, the collar 66 operating to vary the size of the air opening 64 to control the volume of air introduced through the delivery tube 58 air opening 64.

In one operational embodiment, there are two air openings formed through the delivery tube 58 and two alignable openings formed through the collar 66. A grip 70 is connected to the collar 66 by a chain 72. The grip 70 is supported on a plate 74 and positioned so that an operator can move the collar 66 by pulling the chain 72 via the grip 70, the grip 70 being remotely supported with respect to the collar.

During the operation of the material moving apparatus 10, material such as insulation is loaded into the chamber 18 via the material receiving opening 14, the material moving downwardly through the chamber 18 generally from the upper end 26 toward the lower end 28 of the hopper 12. As the material passes through the chamber 18, the material is contacted by the rotating blades 42 where the material is shredded to the desired material density or size. The material is moved via the auger action of the hopper blade assembly 20 from the chamber 18 into and through the material discharge opening 16, the material being passed from the material discharge opening 16 into the delivery tube 58 opening. The material passes through the delivery tube 58 into the blower inlet of the blower assembly 22, air being introduced into the stream of material passing through the delivery tube 58 via the air opening 64 with the amount of air being introduced into the delivery tube 58 opening being controlled by the position of the collar 66 on the delivery tube 58. The material is forcibly discharged from the blower assembly 22 via the blower discharge into and through the discharged conduit 24. The material is discharged from the material moving apparatus 10 via the discharge conduit 24. In an operational application, an additional conduit is connected to the discharge conduit 24 to receive the material discharge from the material moving apparatus 10 for blowing the material into the desired location by positioning such additional flexible conduit (not shown).

As mentioned before, the material moving apparatus 10 is particularly useful for blowing insulation into portions of various structures. Thus, all of the components of the material moving apparatus 10 are contained within a retainer 80 so that the material moving apparatus can be easily transported to various remote locations. The retainer 80 can be installed in a pickup truck or a truck-van type of vehicle thereby providing the required mobility of the material moving apparatus 10.

In applications wherein the material moving apparatus 10 is utilized for blowing insulation materials, it has been found that the length of the delivery tube 66 needs to be sufficient to allow the insulation material to form a plug prior to entering the blower inlet of the blower assembly 22. In one application, it has been found that the length of the delivery tube 58 should be between six and nine inches in length and it has been found that where the length of the delivery tube 58 is shorter than six inches, the material moving apparatus 10 will not function properly.

The blades 42 must be of a sufficient length to cut the insulation material in the hopper chamber 18 and to keep the material within the chamber 18 agitated, thereby substantially preventing the insulation material from bridging.

The hopper 12 is designed such that the first and the second side walls 30 and 32 and the first end wall 34 are substantially straight and these straight walls 30, 32 and 34 cooperate with the curved or rounded bottom to substantially eliminate bridging problems when utilizing the material moving apparatus 10 for blowing insulation type materials.

The material moving apparatus 10 is designed to substantially reduce the number of moving parts and to eliminate belts, pulleys, chains or sprockets, thereby reducing maintenance and repair or replacement expense.

The material moving apparatus 10 has only two moving parts, the blowing assembly 22 and the hopper blade assembly 24, thereby reducing maintenance and repair problems. In prior applications there have been substantially more moving parts.

The material shred density can be adjusted during utilization of the material moving apparatus 10 by adjusting the blade position on the shaft 40 and the pitch of the blades 42. It is desirable to have a material density adjustment because commercially available insulation materials differ in class and character and because even insulation materials of the same kind are furnished in bags of various volume for the same weight by different manufacturers.

Utilizing the material moving apparatus 10 of the present invention, the insulation material is shredded as the insulation material is conveyed via the auger action of the hopper blade assembly 20. The blades 42 of the hopper blade assembly 20 cooperate or act to reduce "clumps" in the insulation material while the material is being conveyed.

Changes may be made in the construction and operation of the various elements and assemblies described herein without departing from the spirit and the scope of the invention as defined in the following claims.

What is claimed is:

1. A material moving apparatus, comprising:

a hopper having an upper end and a lower end, a material receiving opening being formed in the upper end, the hopper having a chamber and a material discharge opening, material being dischargable into the chamber through the material receiving opening and the material being movable from the chamber through the material discharge opening, the lower end portion of the hopper being formed on a radius;

a hopper blade assembly disposed in the hopper chamber for shredding the material discharged into the hopper chamber, the hopper blade assembly cooperating to shred the material and cooperating to move the material from the hopper chamber through the material discharge opening, comprising:

a shaft rotatably mounted and extending through a portion of the hopper chamber;

at least two blades, each blade being connected to the shaft and extending a distance radially therefrom terminating with an outermost end; and means to rotatingly drive the shaft, thereby rotating the blades within the hopper chamber, the lower end portion of the hopper being formed on the radius and shaped to provide a minimum clearance between the outermost ends of the blades of the hopper blade assembly and the lower end portion of the hopper;

a blower assembly for receiving substantially all of the material discharged through the hopper material discharge opening and forcibly discharging the received material through a blower discharge; and a discharge conduit connected to the blower discharge and receiving substantially all of the material discharged from the material discharge opening, substantially all of the material being discharged from the material moving apparatus via the discharge conduit.

2. The apparatus of claim 1 wherein the hopper includes an upper end and a lower end, the material receiving opening being formed in the upper end and an upper portion of the hopper being shaped to move the material toward the lower end.

3. The apparatus of claim 2 wherein the hopper includes a first end wall, a second end wall, a first side wall and a second side wall, the walls being interconnected to encompass a portion of the hopper chamber and at least one of the walls being positioned on an incline, the inclined wall cooperating to move the material toward the lower end.

4. The apparatus of claim 1 wherein the hopper includes a first end wall, a second end wall, a first sidewall, a second sidewall and a lower end wall formed on a radius to minimize the clearance between the outermost ends of the blades of the hopper blade assembly and the lower end wall of the hopper.

5. The apparatus of claim 4 wherein the material discharge opening in the hopper is formed through the second end wall generally near the lower end of the hopper so the material discharged into the hopper chamber flows through the area in the hopper chamber where the blades are disposed prior to being disposed near the hopper material discharge opening to substantially assure the material is engaged via the blades prior to being moved from the hopper chamber through the material discharge opening.

6. The apparatus of claim 4 wherein at least two of the blades are disposed on the shaft such that a portion of said blades generally near the outermost ends are disposed near the hopper material discharge opening.

7. The apparatus of claim 4 wherein the blades are defined further to include:

a first pair of blades, each blade being connected to the shaft and extending radially therefrom in generally opposite directions, the first pair of blades being disposed generally near the second end wall;

a second pair of blades, each blade being connected to the shaft and extending generally radially therefrom at a predetermined angle;

a third pair of blades, each blade being connected to the shaft and extending generally radially therefrom at a predetermined angle; and a fourth pair of blades, each blade being connected to the shaft and extending generally radially therefrom at a predetermined angle, the angular disposition of the second, third and fourth pairs of blades being determined to cooperate in moving the material disposed in the hopper chamber near the lower end from the hopper chamber and through the material discharge opening.

8. The apparatus of claim 7 wherein the second pair of blades is angularly disposed to pass through a first reference line extending radially from the shaft and disposed between the second pair of blades and the third pair of blades, and wherein the third pair of blades is angularly disposed to pass through the first reference line.

9. The apparatus of claim 8 wherein the third pair of blades is angularly disposed to pass through a second reference line extending radially from the shaft and disposed between the third pair of blades and the fourth pair of blades, and wherein the fourth pair of blades is angularly disposed to pass through the second reference line.

10. The apparatus of claim 7 wherein each of the blades of the first, the second, the third and the fourth are pitched at a predetermined blade angle to cooperate in moving the material from the hopper chamber through the material discharge opening.

11. The apparatus of claim 1 defined further to include:

a delivery tube having an opening extending therethrough, one end of the delivery tube being connected to the hopper and positioned such that the delivery tube opening is in communication with the hopper material discharge opening and the opposite end of the delivery tube being connected to the blower assembly, the material being discharged from the hopper chamber through the material discharge opening and through the delivery tube opening to the blower assembly, the delivery tube having an air opening formed through a portion thereof in communication with the delivery tube opening for introducing air into the stream of material flowing through the delivery tube opening to the blower.

12. The apparatus of claim 11 defined further to include:

means for varying the size of the air opening in the delivery tube to control the volume of air introduced into the delivery tube opening.

* * * * *